US006997528B2

(12) United States Patent
Yang

(10) Patent No.: US 6,997,528 B2
(45) Date of Patent: Feb. 14, 2006

(54) RAIL ASSEMBLY FOR FURNITURE

(76) Inventor: Jun-Long Yang, No. 33, Da-Hsin 15th St., Tai-Ping City, Taichung Hsien (TW)

( * ) Notice: Subject to any disclaimer, the term of this patent is extended or adjusted under 35 U.S.C. 154(b) by 127 days.

(21) Appl. No.: 10/694,728

(22) Filed: Oct. 29, 2003

(65) Prior Publication Data

US 2005/0093406 A1 May 5, 2005

(51) Int. Cl.
*A47B 88/00* (2006.01)

(52) U.S. Cl. ..... 312/333; 312/334.46; 312/319.1

(58) Field of Classification Search ..... 312/332.1, 312/319.1, 333, 334.44, 334.46, 334.47; 384/21

See application file for complete search history.

(56) References Cited

U.S. PATENT DOCUMENTS 5,240,318 A * 8/1993 Schroder et al. ..... 312/319.1
5,302,016 A * 4/1994 Lautenschlager et al. ... 312/333
5,364,179 A * 11/1994 Brustle et al. ..... 312/333
5,474,375 A * 12/1995 Hollenstein et al. ..... 312/319.1
6,652,050 B1 * 11/2003 Lin ..... 312/334.46
6,672,692 B1 * 1/2004 Weng ..... 312/334.46
6,733,097 B1 * 5/2004 Kim et al. ..... 312/319.1
6,736,471 B1 * 5/2004 Lin ..... 312/333
6,799,817 B1 * 10/2004 Chu ..... 312/334.46
2004/0000850 A1 * 1/2004 Lam Harn et al ..... 312/333
2004/0056573 A1 * 3/2004 Chae ..... 312/333
2004/0183411 A1 * 9/2004 Boks ..... 312/333
2004/0239218 A1 * 12/2004 Jurja ..... 312/333

FOREIGN PATENT DOCUMENTS

JP 03165712 * 7/1991 ..... 312/334.46

* cited by examiner

*Primary Examiner*—Lanna Mai
*Assistant Examiner*—Hanh V. Tran
(74) *Attorney, Agent, or Firm*—Fei-Fei Chao; Bingham McCutchen LLP

(57) ABSTRACT

A rail assembly for furniture has a stationary track, an internal track, a sliding frame, a latch bracket and a resilient latch. When the internal track and sliding frame are pushed in, the resilient latch engages the sliding frame as the sliding frame releases the resilient latch from an extended position. The latch bracket automatically pulls the resilient latch and the attached sliding frame to a completely closed position.

4 Claims, 8 Drawing Sheets

RAIL ASSEMBLY FOR FURNITURE

BACKGROUND OF THE INVENTION

1. Field of the Invention

The present invention relates to a rail assembly for furniture containing drawers, and more particularly to a rail assembly that can prolong a useful life.

2. Description of Related Art

To make a drawer close automatically, manufacturers often include a spring in a rail assembly for a drawer. However, a conventional rail assembly often has a complex structure, and the cost of the rail assembly is high. Furthermore, the conventional rail assembly only has one spring that easily breaks due to elastic fatigue.

To overcome the shortcomings, the present invention provides a rail assembly for furniture to mitigate or obviate the aforementioned problems.

SUMMARY OF THE INVENTION

The primary objective of the present invention is to provide a rail assembly for furniture to prolong a useful life of the rail assembly. The rail assembly has a stationary track, an internal track, a sliding frame, a latch bracket and a resilient latch assembly. When the internal track and sliding frame are pushed in, the resilient latch assembly engages the sliding frame as the sliding frame releases the resilient latch assembly from an extended position. The latch bracket automatically pulls the resilient latch assembly and the attached sliding frame to a completely closed position.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
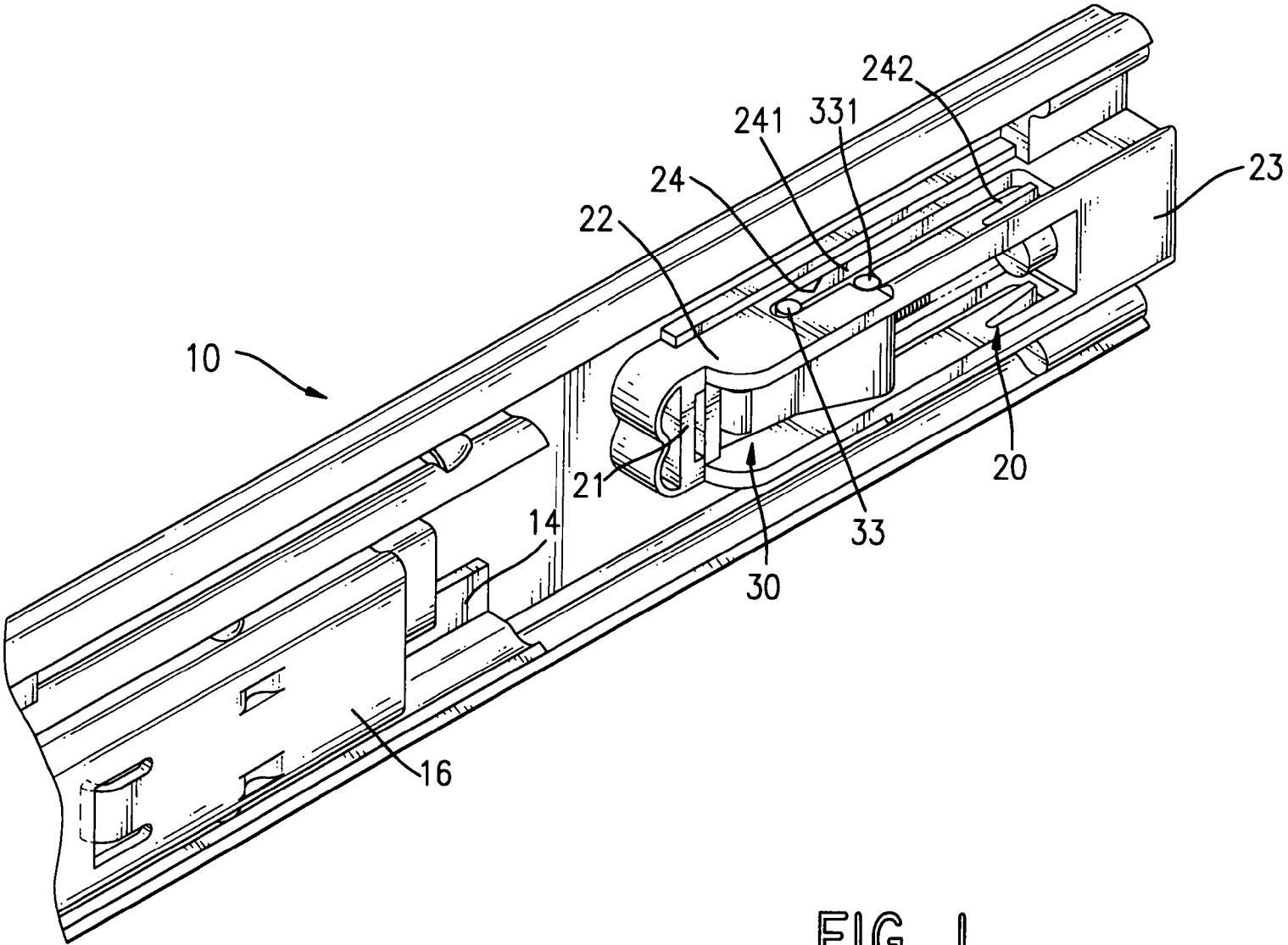
FIG. 1 is a perspective view of a rail assembly for furniture in accordance with the present invention.
Figure 2:
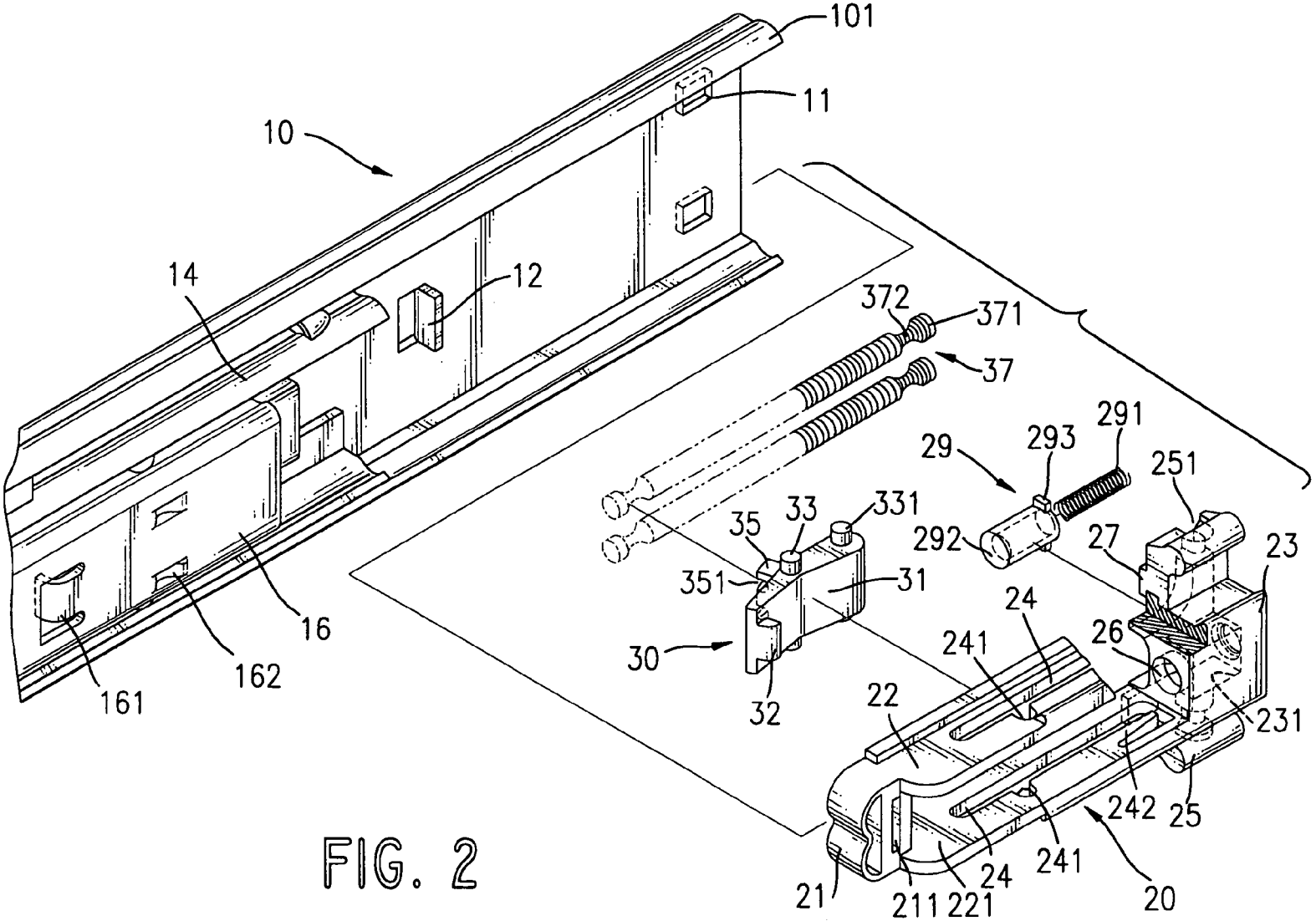
FIG. 2 is an exploded perspective view of the rail assembly for furniture in FIG. 1.
Figure 3:
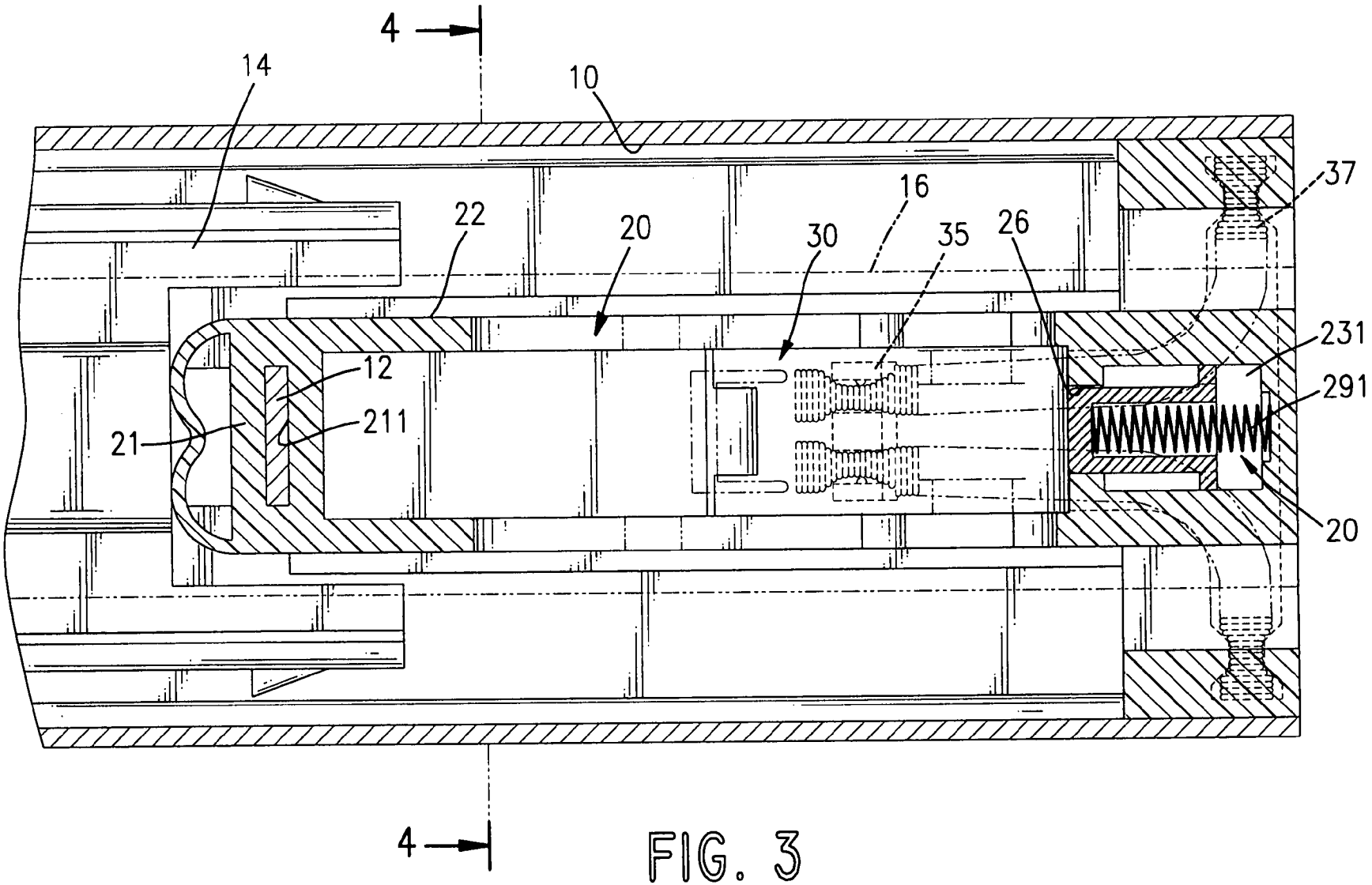
FIG. 3 is an enlarged side plan view in partial section of the rail assembly for furniture in FIG. 1.
Figure 4:
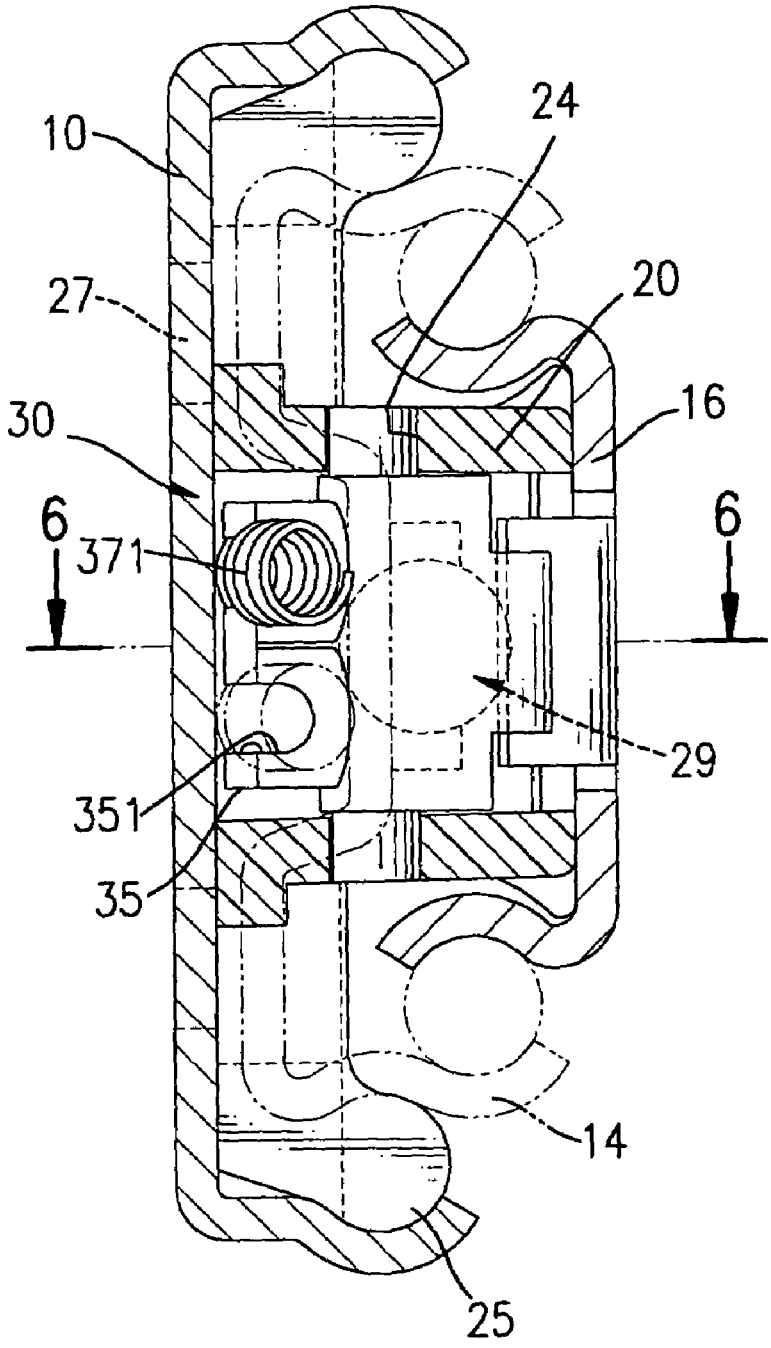
FIG. 4 is an enlarged front plan view in partial section of the rail assembly along line 4—4 in FIG. 3.

With reference to FIGS. 1 to 4, a rail assembly for furniture in according to the present invention has a stationary track (10), an internal track (14), a sliding frame (16), a latch bracket (20) and a resilient latch assembly (30).

The stationary track (10) is U-shaped and has an inner end (not numbered), an outer end (not numbered), a web (not numbered), two side edges (not numbered) and two longitudinal guides (101). The web has an inner surface (not numbered), an outer surface (not numbered), two locking holes (11) and a mounting tab (12). The locking holes (11) are defined through the web near the inner end of the stationary track (10) and are aligned transversely with each other. The mounting tab (12) is formed on and extends perpendicular from the inner surface of the web at a distance from the locking holes (11) toward the outer end of the stationary track (10). The longitudinal guides (101) are defined respectively at the side edges.

The internal track (14) is mounted moveably inside the stationary track (10) and is conventional so further description of the features and operation is not included.

The sliding frame (16) is mounted slidable inside the internal track (14) in a conventional manner so further discussion of the features associated with mounting the sliding frame (16) inside the internal track (14) is not included. The sliding frame (16) has an inner end (not numbered), an outer end (not numbered), a web (not numbered), two protrusions (162) and a latch tab (161). The web has an inner surface (not numbered) and an outer surface (not numbered). The inner surface of the web faces the inner surface of the stationary track (10) web. The protrusions (162) are formed on and protrude from the inner surface of the web near the inner end of the sliding frame (16). The latch tab (161) is also formed on and protrudes from the inner surface of the web a distance from the protrusions (162) toward the outer end of the sliding frame (16).

The latch bracket (20) is mounted securely at the inner end of the stationary track (10) on the inner surface of the web and has an inner end (not numbered), an outer end (21), a body (23), two keys (25), an upper rail (22), a lower rail (221) and a buffer (29). The body (23) has an outer end surface (not numbered), a rear surface (not numbered), a cavity (231), a through hole (26), a top side (not numbered), a bottom side (not numbered) and two locking protrusions (27). The cavity (231) is defined in the rear surface of the body (23), the through hole (26) is defined in the outer end surface and communicates with the cavity (231). Each locking protrusion (27) is respectively formed on the rear surface of the body (23) besides the cavity (231).

The keys (25) are integrally formed respectively on the top side and the bottom side of the body (23) and are mounted respectively inside the longitudinal guides (101) of the stationary track (10). Each key (25) has a rear surface (not numbered) and a spring holder (251). The spring holders (251) are recessed and communicate with the cavity (231) in the body (23).

The outer end (21) is a reversed B-shape and has a transverse mounting slot (211). The upper rail (22) and the lower rail (221) are formed integrally with the body (23), extend from the outer end surface parallel to each other, and respectively have longitudinal guide slots (24). Each longitudinal guide slot (24) has an inner end (not numbered), a transverse stop notch (241) and an outer end (not numbered). The inner end is J-shaped and has a tongue (242). The transverse stop notches (241) are formed near the outer ends of the longitudinal guide slot (24) and are aligned with each other.

The latch bracket (20) is attached to the inner surface of the web of the stationary track (10) by mounting the locking protrusions (27) respectively inside the locking holes (11) and the mounting slot (211) on the mounting tab (12).

The buffer (29) is mounted inside the cavity (231) in the body (23) to absorb energy when a drawer closes and has a buffer spring (291) and a tube (292). The tube (292) has an open end (not numbered), a closed end (not numbered) and two wings (293). The wings (293) are formed on and extend out radially from the open end of the tube (292). The closed end of the tube (292) extends out of the through hole (26) in the body (23), and the wings (293) abut the cavity (231) in the body (23). The buffer spring (291) is mounted inside the open end of the tube (292) between the cavity (231) and the tube (292) and holds the tube (292) in the through hole (26).

The resilient latch assembly (30) is slidable mounted inside the latch bracket (20) and has a latch (31) and two springs (37). The latch (31) is slidable mounted between the upper rail (22) and the lower rail (221) and has an outer end (not numbered), an inner end (not numbered), a front surface (not numbered), a rear surface (not numbered), a top side (not numbered), a bottom side (not numbered), a middle portion (not numbered), two guide posts (33), two locking posts (331), a spring bracket (35) and a hook (32). The guide posts (33) are formed respectively on the top side and the bottom side at the middle portion, and the locking posts (331) are formed respectively on the same sides as the guide posts (33) near the inner end. The posts (33, 331) are slidably mounted respectively inside the longitudinal guide slots (24), and the locking posts (331) are selectively held respectively inside the transverse stop notches (241) to hold the latch (31) at the outer end (21) of the latch bracket (20). The spring bracket (35) is formed on the rear surface of the latch (31) at the middle portion and has two notches (351). The hook (32) is formed on and extends out from the front surface of the latch (31) at the outer end.

The springs (37) are mounted between the latch (31) and the body (23). Each spring (37) has two ends (371) and two necks (372) that are respectively near the ends (371). One end (371) of each spring (37) is mounted in the corresponding spring holder (251) on the wing (25), and the other end (371) is mounted in the corresponding notch (351) in the spring bracket (35) by mounting the necks (371) respectively in the notches (351) and the spring holders (251).

Figure 5:
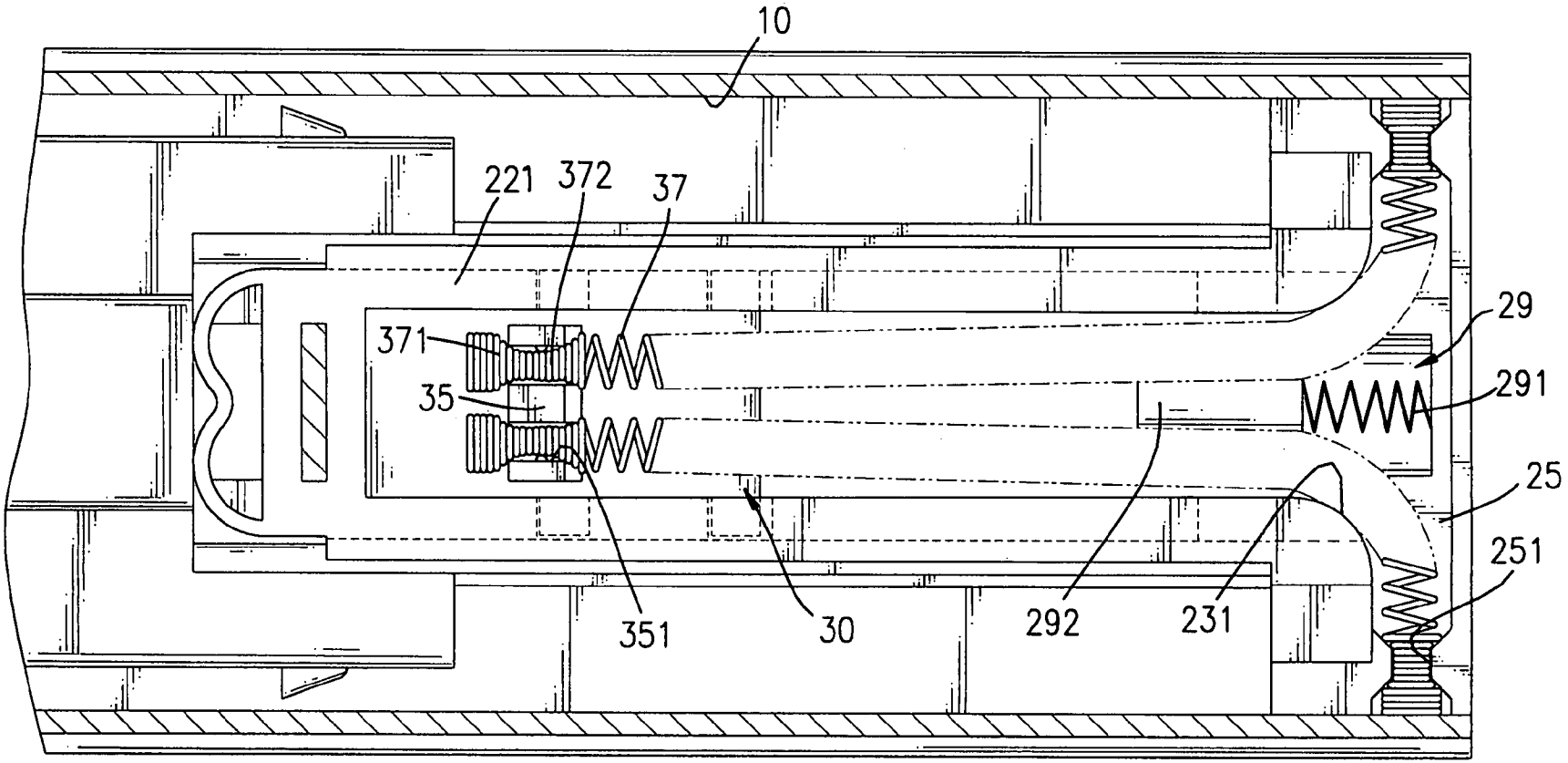
FIG. 5 is an enlarged side plan view in partial section of the rail assembly for furniture in FIG. 1.
Figure 6:
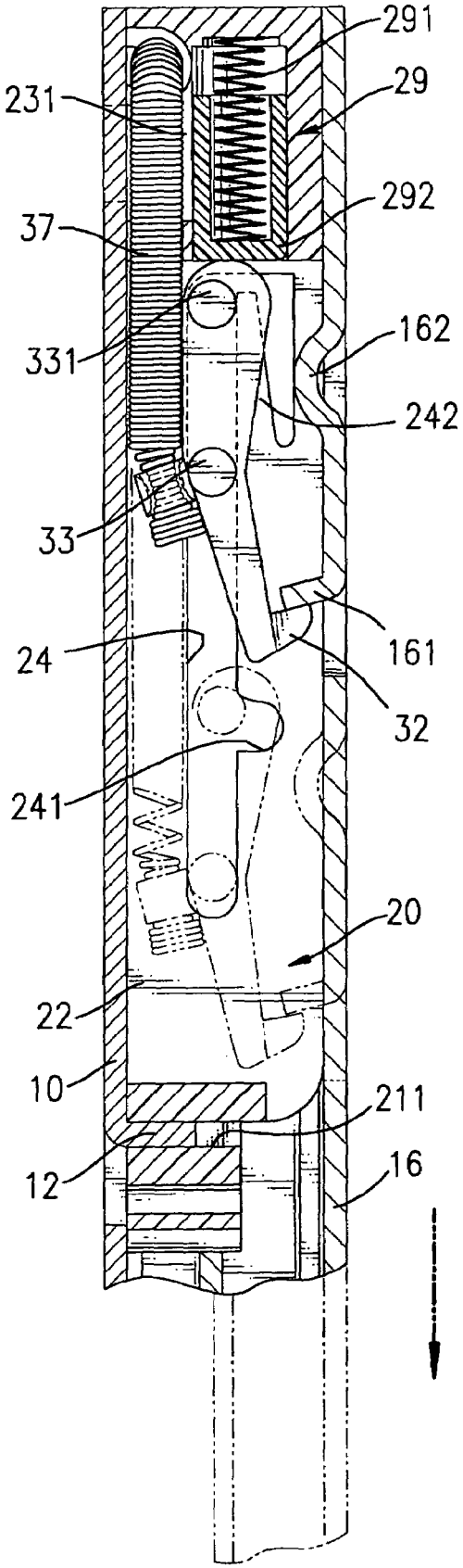
FIG. 6 is an enlarged top plan view in partial section of the rail assembly for furniture along line 6—6 in FIG. 4.
Figure 7:
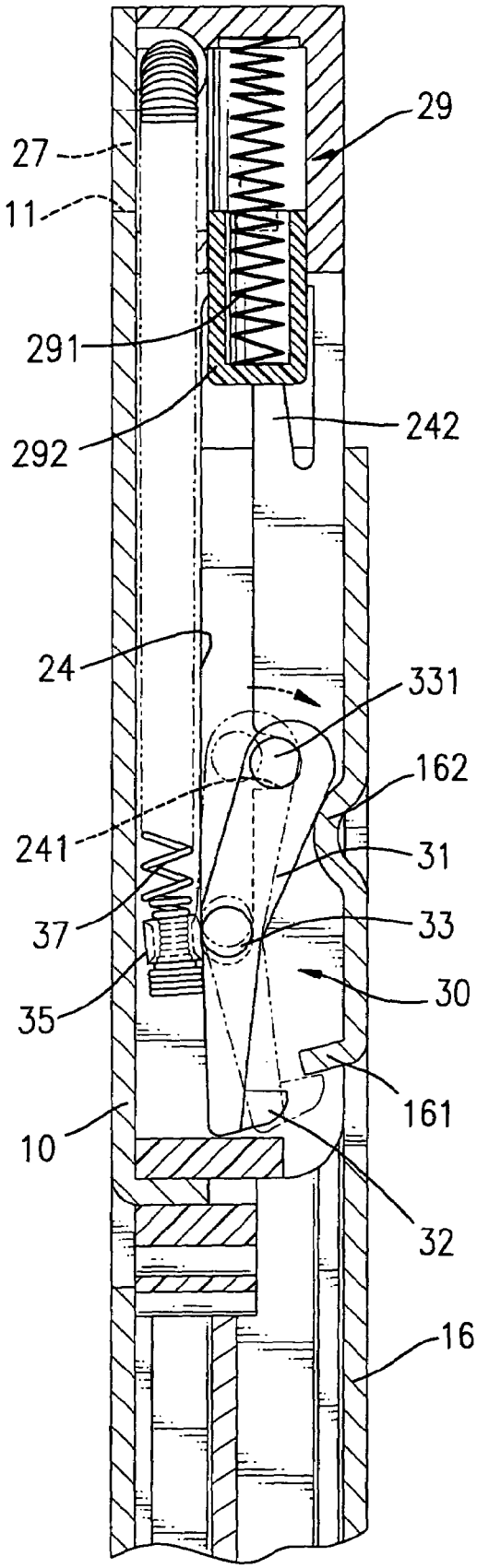
FIG. 7 is an enlarged operational top plan view in partial section of the rail assembly for furniture in FIG. 6.
Figure 8:
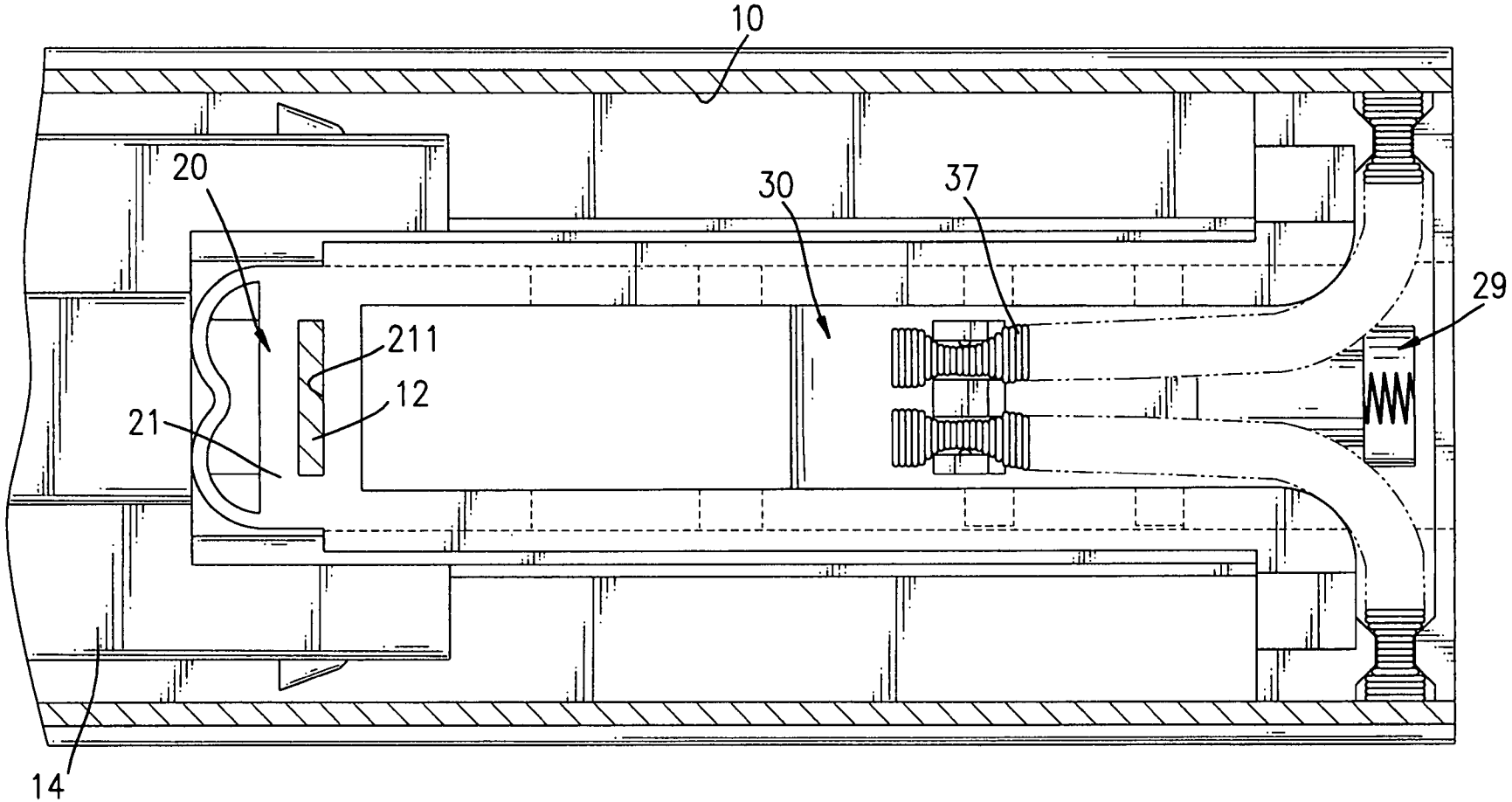
FIG. 8 is an enlarged side plan view in partial section of the rail assembly for furniture in FIG. 1.

With reference to FIGS. 5 to 8, the locking posts (331) move into the transverse stop notches (241) of the upper rail (22) and the lower rail (221) when a drawer (not shown) with the rail assembly in accordance with the present invention is opened. When the locking posts (331) move into the transverse stop notches (241), the resilient latch assembly (30) will pivot causing the hook (32) to release the latch tab (161) and allow the sliding frame (16) to be pulled out.

When the sliding frame (16) is pushed in, the protrusions (162) press against the inner end of the latch (31) and push the locking posts (331) out of the transverse stop notches (24) and cause the hook (32) to engage the latch tab (161). Because of the elastic force in the springs (37), the latch (31) will be pulled against the body (23). The latch (31) will abut the protruding end of the tube (292) and compress the buffer spring (291) in the buffer (29) to slow the sliding frame (16) as it approaches the body (23). The springs (37) securely hold the latch (31) and the sliding frame (16) against the body (23) until the sliding frame (16) is pulled out to release the latch (31) as previously described.

The rail assembly for furniture in accordance with the present invention has the following advantages:

1. Two springs (37) mounted between the latch bracket (20) and the resilient latch assembly (30) provide a more consistent elastic force over time and last longer than a single spring.
2. The latch tab (161) and the protrusions (162) are defined directly on the sliding frame (16) so other elements are not required to hold the resilient latch assembly (30) in place, which simplified the structure and lowers the cost to produce the rail assembly.

Even though numerous characteristics and advantages of the present invention have been set forth in the foregoing description, together with details of the structure and function of the invention, that the disclosure is illustrative only, and changes may be made in detail, especially in matters of shape, size, and arrangement of parts within the principles of the invention to the full extent indicated by the broad general meaning of the terms in which the appended claims are expressed is to be understood.

What is claimed is:

1. A rail assembly for furniture having
a stationary track having
an inner end;
an outer end;
a web having
an inner surface; and
an outer surface;
two side edges; and
two longitudinal guides formed respectively at the side edges;
an internal track slidably mounted on the stationary track;
a sliding frame slidably mounted on the inner track and having
an inner end;
an outer end;
a web having an inner surface;
two protrusions formed on the inner surface of the web near the inner end; and
a latch tab formed on the, inner surface of the web a distance from the protrusions toward the outer end;
a latch bracket mounted inside the stationary track at the inner end and having
an inner end;
an outer end;
an upper rail having a longitudinal guide slot defined in the upper rail and a transverse stop notch communicating with the longitudinal guide slot;
a lower rail parallel to the upper rail having a longitudinal guide slot defined in the lower rail and a transverse stop notch communicating with the longitudinal guide slot, wherein the longitudinal guide slots and the transverse stop notches are aligned with each other;
a body formed on the inner end and having
a rear surface;
an outer end surface;
a top side;
a bottom side;
a cavity defined in the rear surface; and
a through hole defined in the outer end surface and communicated with the cavity;
two keys formed respectively on the top side and the bottom side of the body and mounted respectively inside the longitudinal guides of the stationary track; and
a buffer mounted inside the cavity in the body to absorb closing energy,
a resilient latch assembly slidable mounted inside the latch bracket and having
a latch slidable mounted inside the latch bracket between the upper rail and the lower rail and having
an outer end; an inner end; a front surface; a rear surface; two sides; a middle portion; two guide posts being respectively formed on one of the sides at the middle portion and slidably mounted inside the longitudinal guide slots; two locking posts being respectively formed on the same sides as the guide posts near the inner end and slidably mounted inside the longitudinal guide slots; a spring bracket formed on the rear surface off the latch at the middle portion with two notches; and a hook formed on the front surface at the outer end; and two springs being mounted between the latch and the body.

2. A rail assembly for furniture having a stationary track having an inner end;

an outer end;

a web having an inner surface; and an outer surface;

two side edges; and two longitudinal guides formed respectively at the side edges;

an internal track slidably mounted on the stationary track;

a sliding frame slidably mounted on the inner track and having an inner end;

an outer end;

a web having an inner surface;

two protrusions formed on the inner surface of the web near the inner end; and a latch tab formed on the, inner surface of the web a distance from the protrusions toward the outer end;

a latch bracket mounted inside the stationary track at the inner end and having an inner end;

an outer end;

an upper rail having a longitudinal guide slot defined in the upper rail and a transverse stop notch communicating with the longitudinal guide slot;

a lower rail parallel to the upper rail having a longitudinal guide slot defined in the lower rail and a transverse stop notch communicating with the longitudinal guide slot, wherein the longitudinal guide slots and the transverse stop notches are aligned with each other;

a body formed on the inner end and having a rear surface;

an outer end surface;

a top side;

a bottom side;

a cavity defined in the rear surface; and a through hole defined in the outer end surface and communicated with the cavity;

two keys formed respectively on the top side and the bottom side of the body and mounted respectively inside the longitudinal guides of the stationary track; and a buffer mounted inside the cavity in the body to absorb closing energy, a resilient latch assembly slidable mounted inside the latch bracket and having a latch slidable mounted inside the latch bracket between the upper rail and the lower rail and having an outer end; an inner end; a front surface; a rear surface; two sides; a middle portion; two guide posts being respectively formed on one of the sides at the middle portion and slidably mounted inside the longitudinal guide slots; two locking posts being respectively formed on the same sides as the guide posts near the inner end and slidably mounted inside the longitudinal guide slots; a spring bracket formed on the rear surface off the latch at the middle portion with two notches; and a hook formed on the front surface at the outer end; and two springs being mounted between the latch and the body, wherein the web of the stationary track further comprises two locking holes defined on the inner surface near the inner end of the stationary track; and a mounting tab formed on the inner surface of the stationary track at a distance from the locking holes toward the outer end;

wherein the latch bracket further comprises a mounting slot transversely defined at the outer end;

the body of the latch bracket has a rear surface; and two protrusions formed on the rear surface and besides the cavity to respectively engage with the corresponding locking holes in the stationary track;

wherein each key of the latch bracket has a spring holder to hold the springs of the resilient latch assembly; and wherein each spring further has two necks mounted respectively inside the spring holders and the latch bracket.

3. The rail assembly as claimed in claim 2, wherein the spring holders communicate with cavity in the body.

4. A rail assembly for furniture having a stationary track having an inner end;

an outer end;

a web having an inner surface; and an outer surface;

two side edges; and two longitudinal guides formed respectively at the side edges;

an internal track slidably mounted on the stationary track;

a sliding frame slidably mounted on the inner track and having an inner end;

an outer end;

a web having an inner surface;

two protrusions formed on the inner surface of the web near the inner end; and a latch tab formed on the, inner surface of the web a distance from the protrusions toward the outer end;

a latch bracket mounted inside the stationary track at the inner end and having an inner end;

an outer end;

an upper rail having a longitudinal guide slot defined in the upper rail and a transverse stop notch communicating with the longitudinal guide slot;

a lower rail parallel to the upper rail having a longitudinal guide slot defined in the lower rail and a transverse stop notch communicating with the longitudinal guide slot, wherein the longitudinal guide slots and the transverse stop notches are aligned with each other;

a body formed on the inner end and having a rear surface;

an outer end surface;

a top side;

a bottom side;

a cavity defined in the rear surface; and a through hole defined in the outer end surface and communicated with the cavity;

two keys formed respectively on the top side and the bottom side of the body and mounted respectively inside the longitudinal guides of the stationary track; and a buffer mounted inside the cavity in the body to absorb closing energy, a resilient latch assembly slidable mounted inside the latch bracket and having a latch slidable mounted inside the latch bracket between the upper rail and the lower rail and having an outer end; an inner end; a front surface; a rear surface; two sides; a middle portion; two guide posts being respectively formed on one of the sides at the middle portion and slidably mounted inside the longitudinal guide slots; two locking posts being respectively formed on the same sides as the guide posts near the inner end and slidably mounted inside the longitudinal guide slots; a spring bracket formed on the rear surface off the latch at the middle portion with two notches; and a hook formed on the front surface at the outer end; and two springs being mounted between the latch and the body, wherein the buffer further comprises a buffer spring; and a tube receiving the buffer spring and having an open end;

a closed end extending out of the through hole in the body; and two wings formed at the open end of the tube to abut the cavity in the body.

* * * * *